US011484902B2

(12) United States Patent
Ahn et al.

(10) Patent No.: US 11,484,902 B2
(45) Date of Patent: Nov. 1, 2022

(54) MANUFACTURING SYSTEM FOR COATING AN ARTICLE

(71) Applicant: NIKE, Inc., Beaverton, OR (US)

(72) Inventors: Hyun Tae Ahn, Jung-Gu Seoul (KR); Tae Woong Heo, Jung-Gu Seoul (KR); Min Ho Jang, Jung-Gu Seoul (KR); Ji Hoo Park, Jung-Gu Seoul (KR)

(73) Assignee: NIKE, Inc., Beaverton, OR (US)

( * ) Notice: Subject to any disclaimer, the term of this patent is extended or adjusted under 35 U.S.C. 154(b) by 114 days.

(21) Appl. No.: 16/698,598

(22) Filed: Nov. 27, 2019

(65) Prior Publication Data

US 2020/0164393 A1 May 28, 2020

Related U.S. Application Data

(60) Provisional application No. 62/772,417, filed on Nov. 28, 2018.

(51) Int. Cl.
*B05B 13/02* (2006.01)
*B05B 12/20* (2018.01)

(52) U.S. Cl.
CPC ..... *B05B 13/02* (2013.01); *B05B 12/20* (2018.02); *B05B 13/0235* (2013.01)

(58) Field of Classification Search
None
See application file for complete search history.

(56) References Cited

U.S. PATENT DOCUMENTS 2,600,161 A 6/1952 Fouse
3,517,645 A 6/1970 Klein
5,849,359 A 12/1998 Burns et al.
6,299,687 B1 * 10/2001 Inaba ..... B05B 12/20 118/301
2007/0062018 A1 3/2007 Albanese et al.
2015/0189951 A1 7/2015 Regan et al.

FOREIGN PATENT DOCUMENTS

CN 106733360 A 5/2017
CN 206184657 U 5/2017

OTHER PUBLICATIONS

International Search Report and Written Opinion received for PCT Patent Application No. PCT/US2019/063758, dated Mar. 19, 2020, 13 pages.
International Preliminary Report on Pantentability received for PCT Patent Application No. PCT/US2019/063758, dated Jun. 10, 2021, 9 pages.

* cited by examiner

*Primary Examiner* — Jethro M. Pence
(74) *Attorney, Agent, or Firm* — Shook Hardy & Bacon, LLP

(57) ABSTRACT

A system is provided for selectively applying a coating to portions of an article having at least one area that is not be coated. The system comprises a jig, with a platform for supporting article. The jig also has a bar that is moveable with respect to the platform and at least one masking element that is coupled to the bar and is configured to cover the at least one surface of the article that is not to be coated. The jig also has a first connection mechanism that defines a first mating element. The system also comprises at least one carrier that comprises a base and at least one second connection mechanism that defines a second mating element. The second mating element is mateable with the first mating element such that the jig is releasably coupled to the carrier upon mating the first and second mating elements.

14 Claims, 13 Drawing Sheets

MANUFACTURING SYSTEM FOR COATING AN ARTICLE

CROSS REFERENCE TO RELATED APPLICATIONS

This application claims benefit of U.S. Provisional Application No. 62/772,417 filed Nov. 28, 2018, entitled "Manufacturing System For Coating An Article", which is incorporated by reference herein in its entirety.

TECHNICAL FIELD

Directed to systems and methods for selectively coating portions of an article.

BACKGROUND

Traditional methods and systems for forming a cushioning article, such as a shoe midsole or sole portion, include the use of fluid filled bags, such as airbags. In some circumstances, it may be desirable to apply a coating, such as a spray paint, to only selected portions of the airbags, leaving other selected areas uncoated.

BRIEF SUMMARY

Aspects hereof contemplate systems and methods for coating selected portions of an article, such as an airbag, used in a cushioning article, such as an article of footwear. Specifically, aspects hereof contemplate a system for selectively applying a coating to portions of an article having at least one area that is not be coated. The system comprises at least one jig, with a platform for supporting a surface of the article. The jig also has a bar that is moveable with respect to the platform and at least one masking element that is coupled to the bar and is configured to cover the at least one surface of the article that is not to be coated. The jig also has a first connection mechanism that defines a first mating element. The system also comprises at least one carrier that comprises a base and at least one second connection mechanism that defines a second mating element. The second mating element is mateable with the first mating element such that the jig is releasably coupled to the carrier upon mating the first and second mating elements. In some aspects, the first mating element can be a hollow square tube, and the second mating element is as square prong extending upwardly from the base of the carrier, and the first and second mating elements are non-rotatable with respect to each other. In some aspects, the square prong has a tapered terminal end distal from the base. In some aspects, the base of the carrier supports four second mating elements mateable with a first mating element of a corresponding jig. In other aspects, the bar of the jig is moveable between an open position allowing the article to be placed on the platform and a closed position where the bar maintains the article in place on the platform, and the jig has a closure mechanism releasably securing the bar in the closed position. In some aspects, the closure mechanism has multiple closure settings varying the distance between the at least one masking element and the platform. In certain aspects, the closure mechanism has at least three closure settings. In certain aspects, the platform has a longitudinal axis, and the bar is aligned with the longitudinal axis of the platform. In other aspects, the at least one area not to be covered is a protrusion having a top and at least one side, and the at least one masking element has a top and at least one side wall that cover at least a portion of the top and at least a portion of the side of the protrusion when the bar is in the closed position.

This summary is provided to enlighten and not limit the scope of methods and systems provided hereafter in complete detail.

DESCRIPTION OF THE DRAWINGS

The present invention is described in detail herein with reference to the attached drawing figures, wherein.

DETAILED DESCRIPTION

A system and method for coating selected portions of an article, such as an airbag, used in a cushioning article, such as an article of footwear is described herein. Specifically, aspects hereof contemplate a system for selectively applying a coating to portions of an article having at least one area that is not be coated. The system comprises at least one jig, with a platform for supporting a surface of the article. The jig also has a bar that is moveable with respect to the platform and at least one masking element that is coupled to the bar and is configured to cover the at least one surface of the article that is not to be coated. The jig also has a first connection mechanism that defines a first mating element. The system also comprises at least one carrier that comprises a base and at least one second connection mechanism that defines a second mating element. The second mating element is mateable with the first mating element such that the jig is releasably coupled to the carrier upon mating the first and second mating elements. In some aspects, the first mating element can be a hollow square tube, and the second mating element is as square prong extending upwardly from the base of the carrier, and the first and second mating elements are non-rotatable with respect to each other. In some aspects, the square prong has a tapered terminal end distal from the base. In some aspects, the base of the carrier supports four second mating elements mateable with a first mating element of the corresponding jig. In other aspects, the bar of the jig is moveable between an open position allowing the article to be placed on the platform and a closed position where the bar maintains the article in place on the platform, and the jig has a closure mechanism releasably securing the bar in the closed position. In some aspects, the closure mechanism has multiple closure settings varying the distance between the at least one masking element and the platform. In certain aspects, the closure mechanism has at least three closure settings. In certain aspects, the platform has a longitudinal axis, and the bar is aligned with the longitudinal axis of the platform. In other aspects, the at least one area not to be covered is a protrusion having a top and at least one side, and the at least one masking element has a top and at least one side wall that cover at least a portion of the top and at least a portion of the side of the protrusion when the bar is in the closed position. Additional and alternative elements, functions, and/or components are contemplated herein and will be discussed hereafter.

Figure 1:
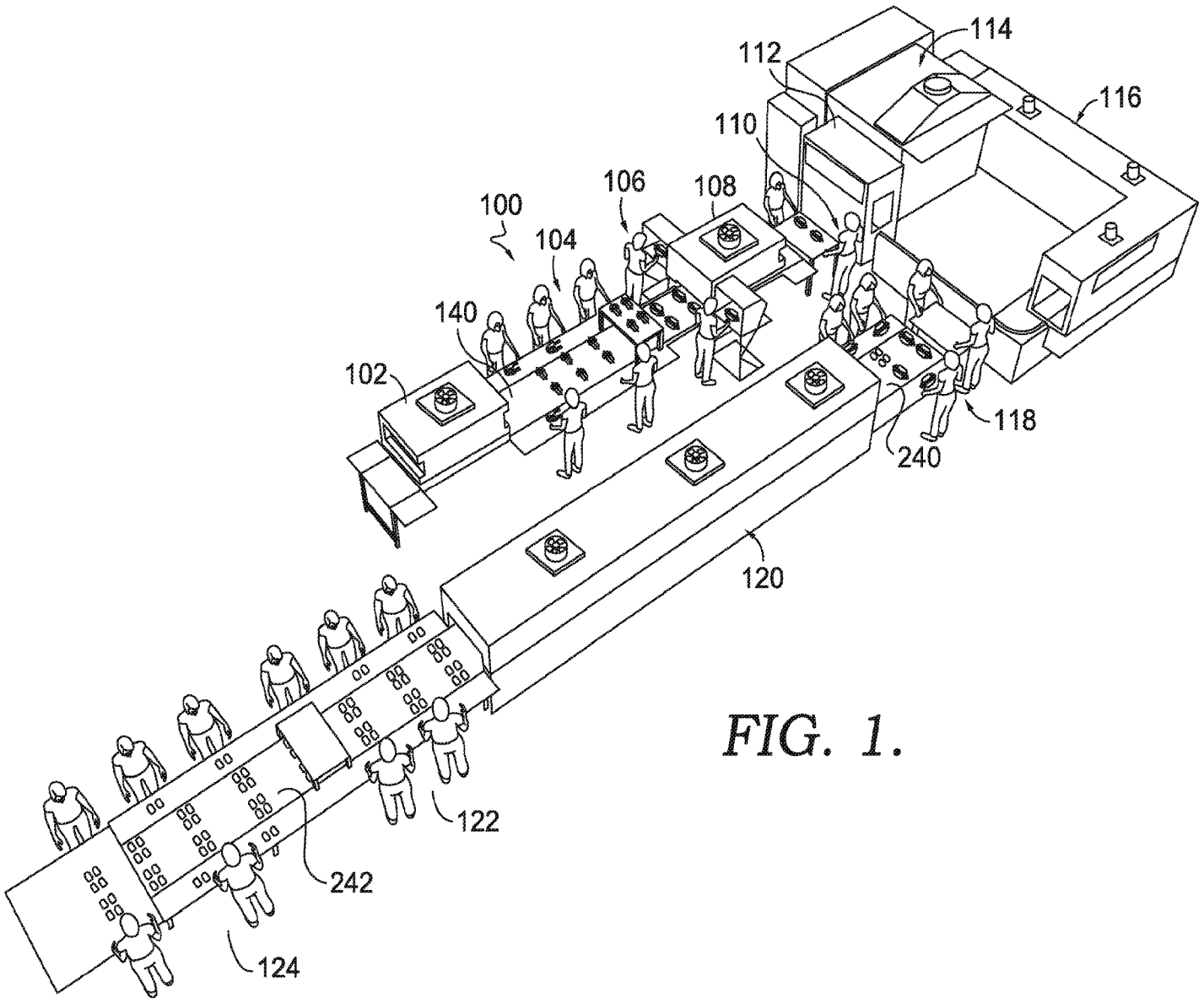
FIG. 1 depicts a system for selectively coating portions of an article, in accordance with aspects hereof.
Figure 2A:
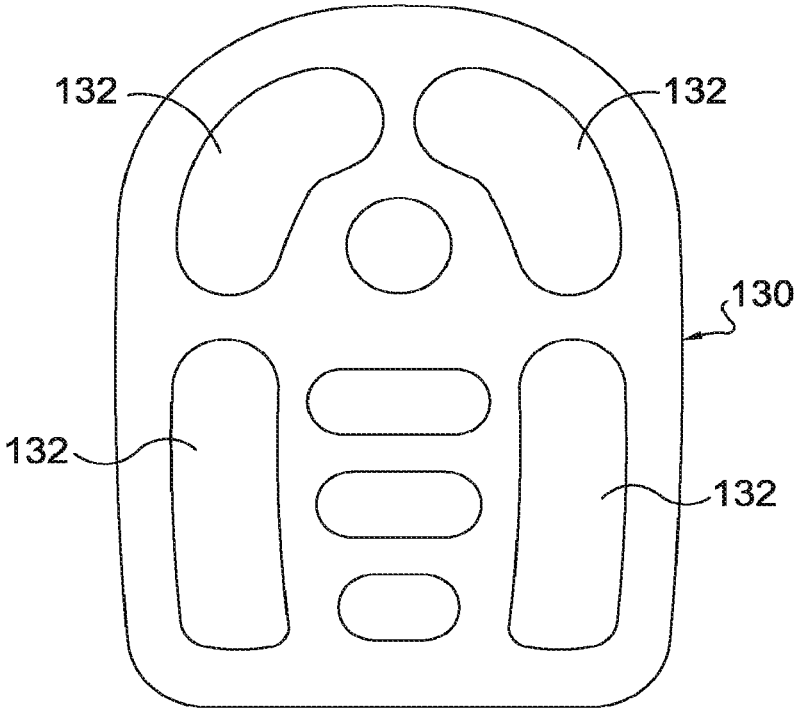
FIGS. 2A and 2B depict views of an airbag, in accordance with aspects hereof.
Figure 2B:
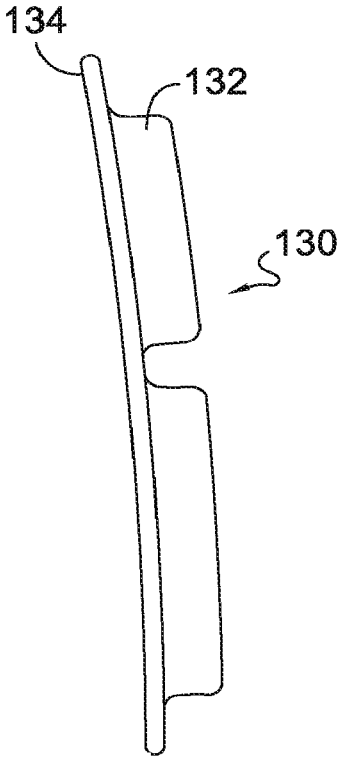

Turning to the figures and specifically to FIG. 1, a system 100 is shown for coating selected portions of an article or component, such as an airbag, used in a cushioning article, such as an outsole for an article of footwear, in accordance with aspects hereof. In some aspects, the system 100 broadly includes a cleaning station 102, a jig loading station 104, a primer station 106, a first drying chamber 108, a carrier loading station 110, a preheating chamber 112, a coating chamber 114, a second drying chamber 116, a carrier unloading station 118, a third drying chamber 120, a jig unloading station 122 and a quality assurance and packing station 124. In certain aspects, there may be more, or fewer drying chambers based on the parts being coated, the coating being applied or other factors. Moreover, in some aspects, some stations, such as the preheating chamber may not be needed. Before describing the system 100 further, an exemplary airbag 130 is shown in FIGS. 2A and 2B. In one aspect, airbag 130 is usable as a cushioning element in a shoe sole. In some aspects, the airbag may be usable in only one area of the shoe sole, such as the forefoot, or heel area. In other aspects, the airbag may usable over a larger portion, or all, of the shoe sole. In some aspects, the airbag 130 has a number of individual, fluid-filled pockets 132 that protrude from a surface 134. In this way, the protrusions, formed by fluid-filled pockets 132, have a top and side portions. As stated above, it may be desirable to coat or paint portions of the airbag 130, while other portions remain uncoated. In one aspect, it may be desirable to mask a portion of selected pockets 132 to allow another component, such as on outsole, to be adhered to the airbag 130. In this aspect, the adhesive may be more effective in adhering the outsole to the airbag 130 in an area without any coating or paint. Airbag 130 is shown in one configuration, having a certain pattern of pockets 132. Other arrangements for pockets 132 on airbag 130 are possible and are within the scope of this disclosure.

Figure 3A:
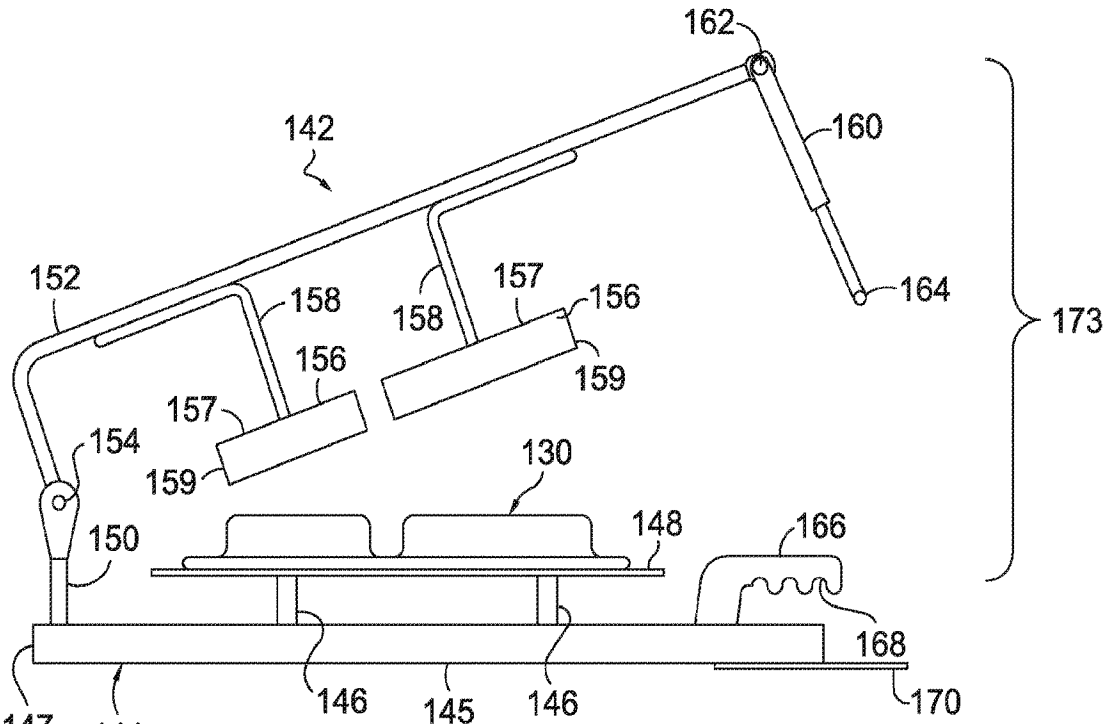
FIG. 3A depicts a jig of the system of FIG. 1 in an open position, in accordance with aspects hereof.
Figure 3B:
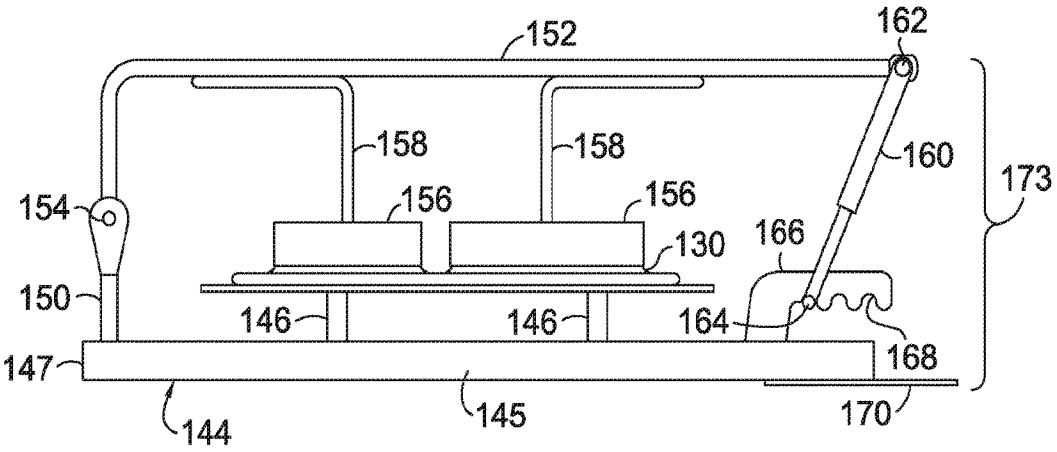
FIG. 3B depicts a jig of the system of FIG. 1 in a closed position, in accordance with aspects hereof.

Returning to FIG. 1, individual airbags 130 are initially loaded onto a conveyor 140 and moved through a cleaning station 102, which may also include a drying operation. Following the cleaning station 102 the airbags are loaded onto a jig 142 (as seen in FIGS. 3A and 3B) at jig loading station 104. As shown in FIG. 3A, in some aspects, jig 142 is designed to hold a corresponding airbag 130 and has a first connection mechanism 144. In some aspects, first connection mechanism 144 is a support tube 145 that acts as a base for the remainder of the jig 142. In some aspects, support tube 145 is made of a square steel tubing, the importance of which is discussed further below. A pair of legs 146 are coupled to the support tube 145, such as by welding, and extend outwardly from the support tube. The ends of the legs 146 opposite the support tube 145 are coupled, such as by welding, to a platform 148. In some aspects, platform 148 is shaped and sized to support surface 134 of a corresponding airbag 130. A spacer element 150 is coupled to the lower end of support tube 145 and extends outwardly therefrom. An elongated bar 152 is pivotally coupled to the outer end of spacer element 150 at pivot point 154. In some aspects, bar 152 is in line with, and generally extends the length of, support tube 145 and a longitudinal axis of platform 148. The bar 152 supports a number of masking elements 156 that are coupled to bar 152 with arms 158. Each masking element is shaped and sized to correspond to a pocket 132, or a portion of a pocket 132, that is not to be coated or painted. In some aspects, the masking elements 156 are cup-shaped, having a top 157 and sides 159, to correspond to the shape of the pocket 132 or portion of a pocket 132 on airbag 130. The end of bar 152 opposite pivot point 154 is pivotally coupled to a finger 160 at pivot point 162. Opposite pivot point 162, a closing pin 164 is coupled to the end of finger 160. At the upper end of support tube 145 (opposite spacer element 150), a rack 166 is coupled to support tube 145, such as by welding. In some aspects, rack 166 is formed with notches 168 that form multiple closure settings. As shown in FIG. 3A, rack 166 has three notches 168, but more, or fewer notches could be used. Additionally, in some aspects, support tube 145 has a plate 170 coupled thereto that defines a hole 172. In some aspects, the materials of jig 142 are rigid, durable materials, such as, for example, steel.

Figure 4:
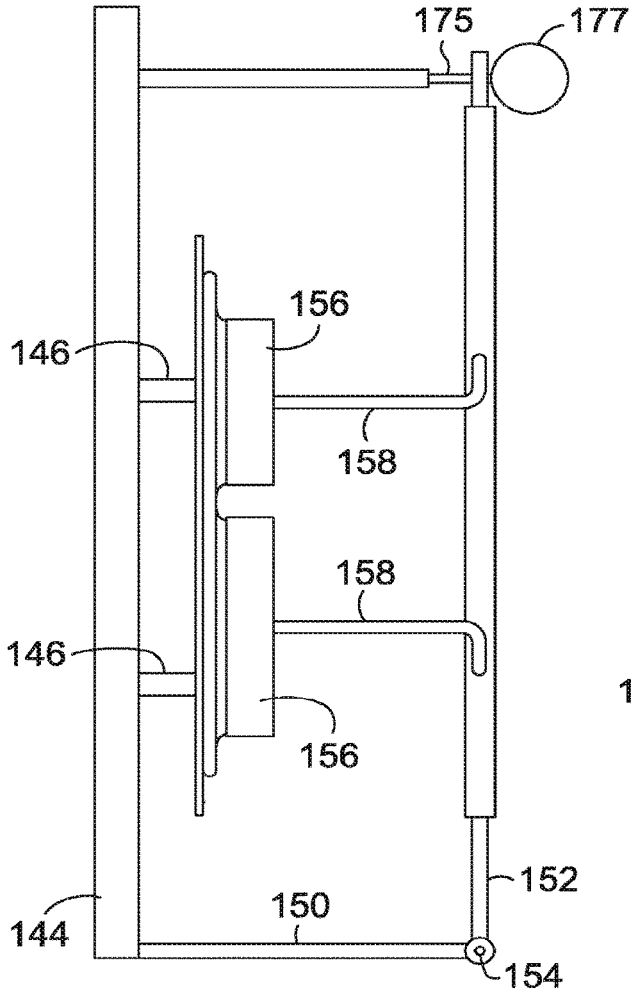
FIG. 4 depicts a jig of the system of FIG. 1 with an alternative closure system, in accordance with aspects hereof.

Returning to FIG. 1, in some aspects, after cleaning station 102, an individual airbag 130 is loaded into jig 142 at jig loading station 104. To load the airbag 130 into jig 142, with bar 152 pivoted away from support tube 145, in an open position, as shown in FIG. 3A, the airbag 130 is placed such that surface 134 of the airbag 130 rests against the platform 148 of jig 142. In some aspects, platform 148 may be formed to facilitate the proper placement of airbag 130, such as, for example, having a shape that corresponds to the shape of surface 134. Once airbag 130 is in place on platform 148, bar 152 is pivoted toward airbag 130, until masking elements 156 abut corresponding pockets 132, or portions of pockets 132, in a closed position. Finger 160 is then pivoted toward rack 166 and closing pin 164 is placed within one the notches 168 in the closed position shown in FIG. 3B. By positioning closing pin 164 within different notches, the masking elements 156 can be moved into tighter, or looser, contact with airbag 130. In some aspects, this adjustment can accommodate airbags 130 of differing thicknesses. As closing pin 164 is moved from the notch 168 farthest from spacer element 150 to succeeding notches closer to spacer element 150, the masking elements 156 are moved closer to airbag 130, tightening the closure. In this arrangement, the finger 160 and rack 166 form a closure mechanism 173. In another aspect, as seen in FIG. 4, a simplified closure mechanism 175 is used that has a twistable closing pin 177 that fits through a corresponding hole at the end of bar 152.

With closure mechanism 175, the bar 152 is not adjustable but is held in a singular closed position by closing pin 177.

Figure 5:
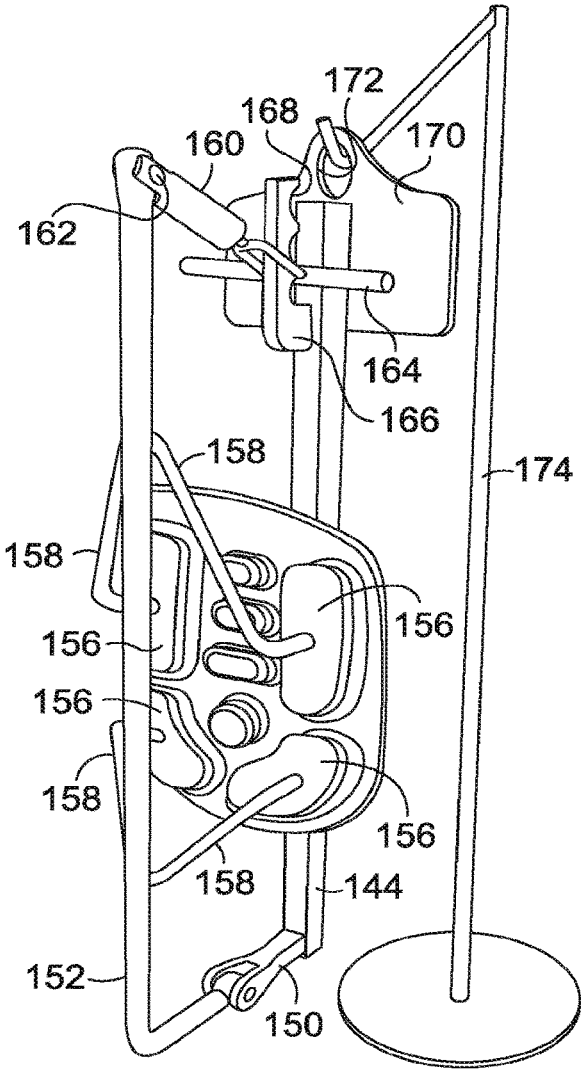
FIG. 5 depicts a jig loaded with an airbag, and loaded onto a stand.

Once the airbag 130 is loaded into jig 142 at jig loading station 104, the loaded jig 142 is moved to the primer station 106. At primer station 106, in some aspects an operator holds the jig and coats the airbag 130 with the primer material using a low pressure spray gun. In other aspects, the jig 142 may be placed on a stand 174 (shown in FIG. 5) using hole 172 in plate 170 to hold the jig 142 on the stand 174. In this aspect, stand 174 relieves the operator of having to hold the loaded jig while applying the primer. After the primer material is applied, the loaded jig 142 with airbag 130 is placed on a conveyor and moved through the first drying chamber 108. Drying chamber 108 may be provided with a heating element, such as a pin heater, and a blower or fan to move the heated air over the airbag 130 and jig 142.

Following the drying chamber 108, the individual jigs 142, loaded with airbags 130, are loaded onto carriers 176. As best seen in FIGS. 6A-6C, each carrier 176 has a base 178 with a mounting hole 180 and a set-screw 184, the importance of which are described below. Base 178 supports a number of extending connection mechanisms 186. In some aspects, each connection mechanism 186 is an individual prong 182. In one aspect, base 178 supports four prongs 182, although more, or fewer, prongs 182 could be supported. Prongs 182, in one aspect, have a square shape that corresponds to the interior shape of support tube 145. In some aspects, prongs 182 taper to a point at the top, while in other aspects the prongs 182 may have a flat top. In some aspects, carrier 176 includes two cross-supports 183 that extend between facing prongs 182, and which are welded to prongs 182. Cross-supports 183 help to maintain the spacing between prongs 182 and reinforce the carrier 176. To load jig 142 on carrier 176, the support tube 145 slides over a corresponding prong 182, with the top taper of the prong 182 guiding the alignment of support tube 145 on prong 182. The interior of support tube 145 defines a first mating element that pairs with a corresponding prong 182 which acts as the corresponding second mating element. Because prong 182 and the interior of support tube 145 are square, jig 142 is held in place in a non-rotational manner with respect to the carrier 176. In other aspects, prong 182 and support tube 145 could be of a different shape than square, such as hexagonal or triangular, such that they do not rotate relative to one another. The male/female relationship could also be changed, such that support tube 145 is a solid (male fitting) and the prong 182 is a mostly hollow (female fitting) with an elongated slot allowing the support tube 145 to rest within the prong 182. Additionally, in some aspects, jig 142 may be connected to carrier 176 in a non-removeable fashion, although this is not preferred. In this aspect, airbag 130 is loaded into the jig 142/carrier 176 combination, typically before preheating chamber 112.

Figure 6:
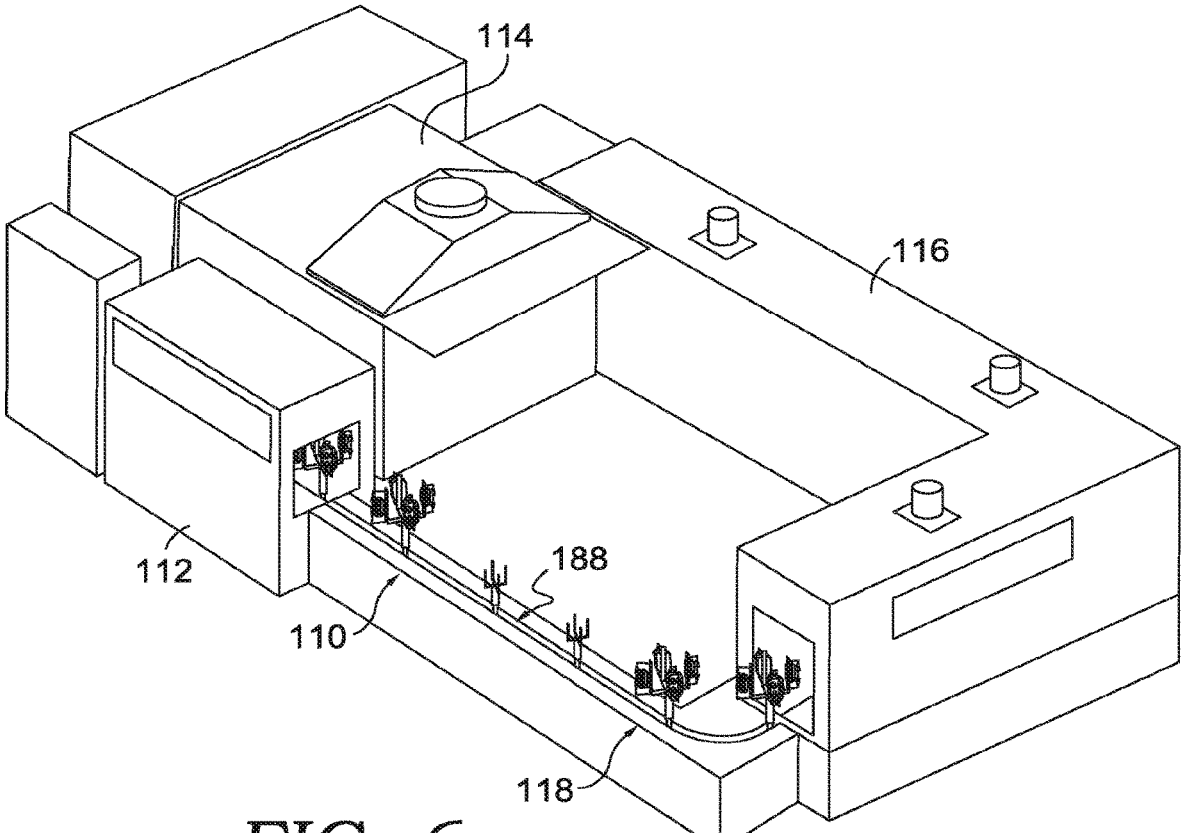
FIG. 6 depicts a portion of the system of FIG. 1, in accordance with aspects hereof.
Figure 6A:
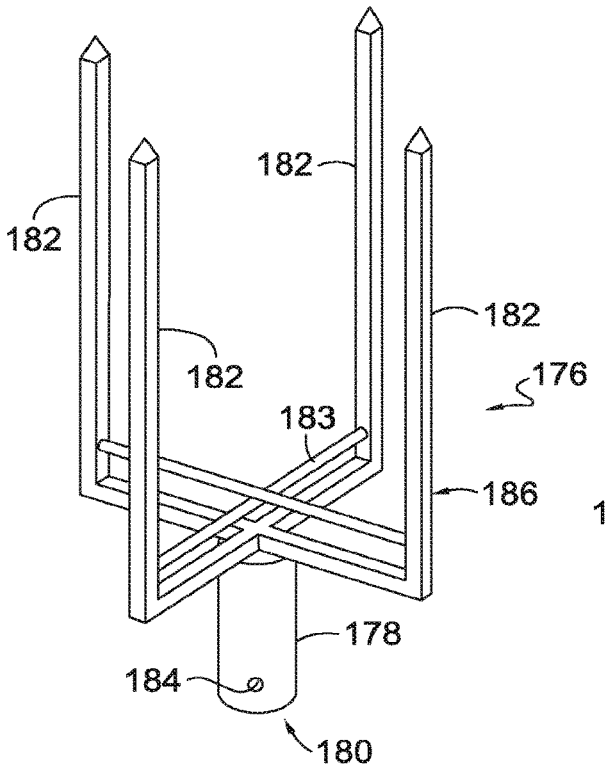
FIG. 6A depicts an unloaded carrier of the system of FIG. 1.
Figure 6B:
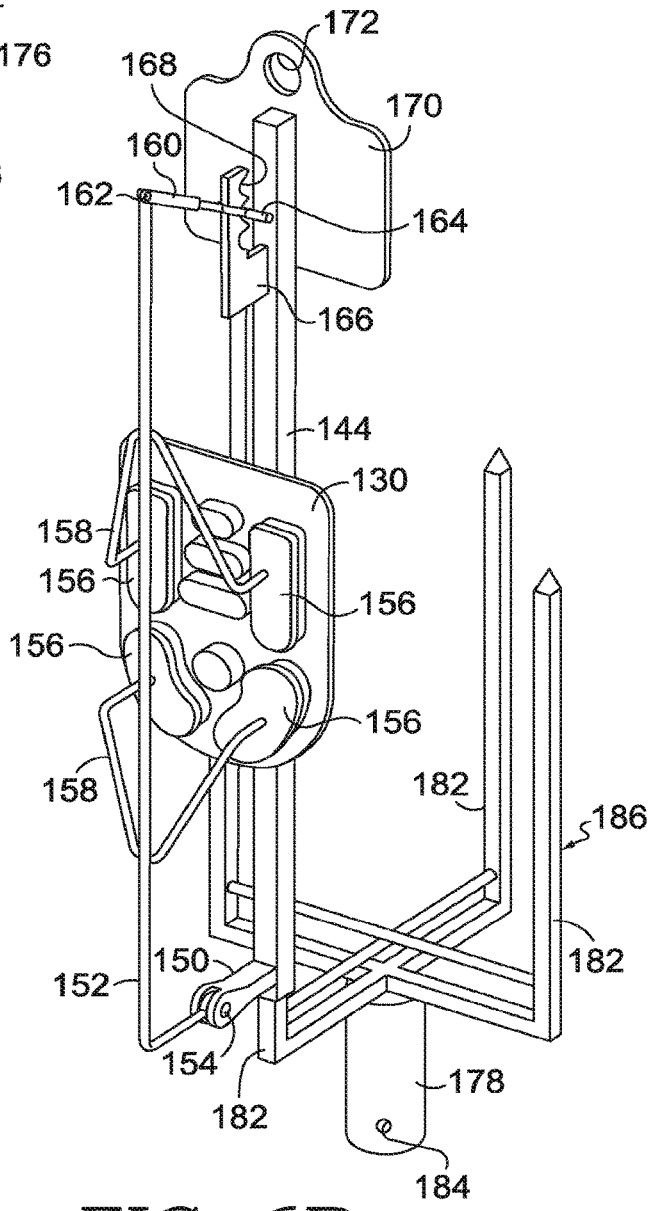
FIG. 6B depicts a partially loaded carrier of the system of FIG. 1, shown with one jig loaded on the carrier.
Figure 6C:
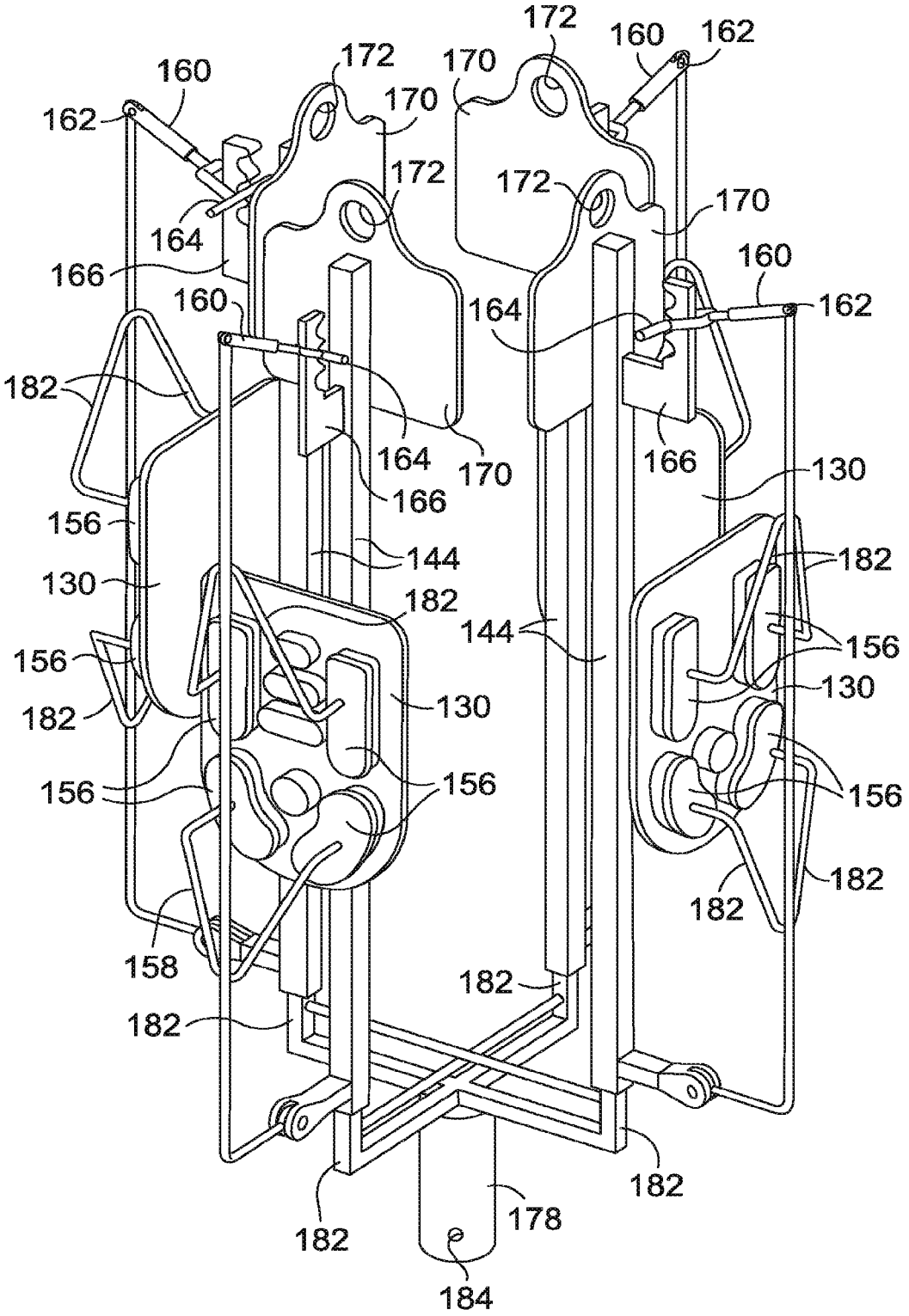
FIG. 6C depicts a fully loaded carrier of the system of FIG. 1, with four jigs loaded onto the carrier.
Figure 6D:
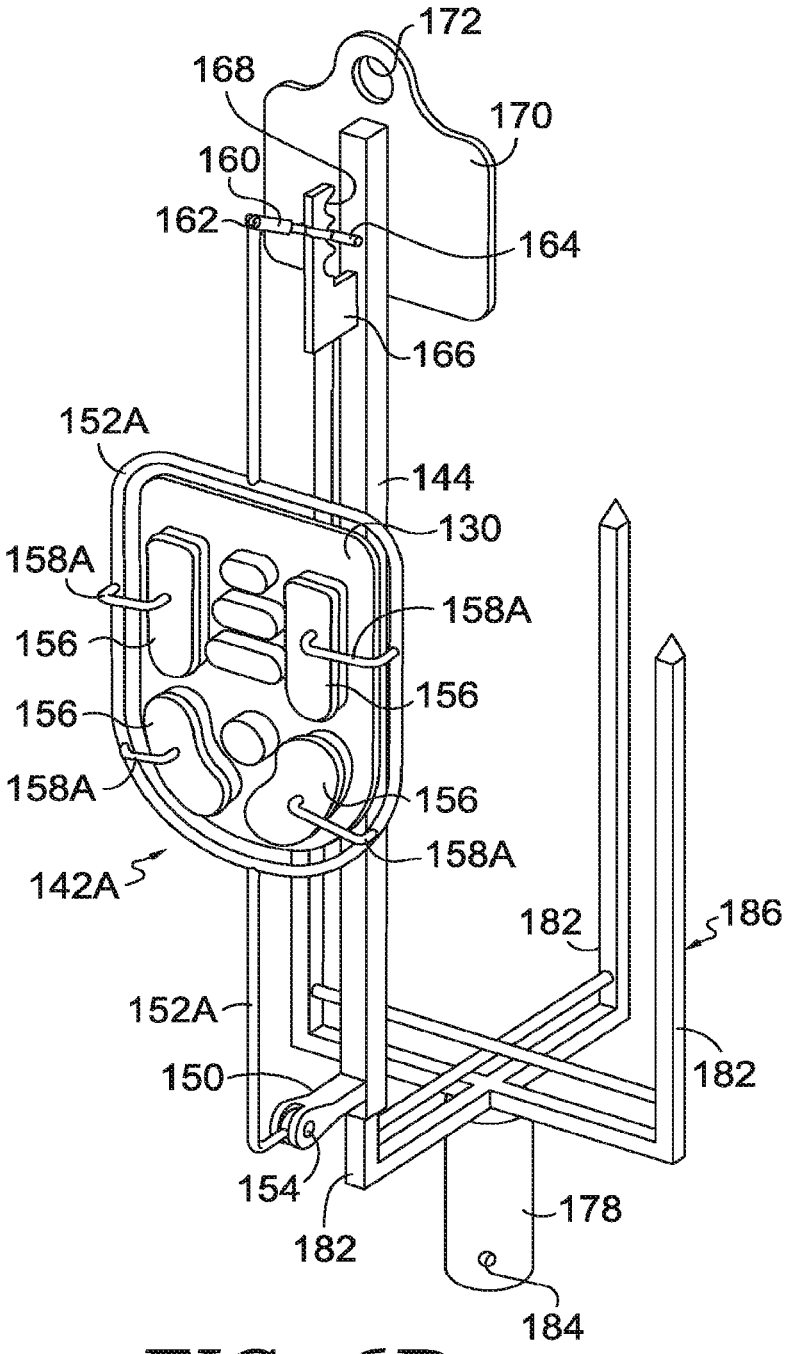
FIG. 6D depicts a partially loaded carrier of the system of FIG. 1, similar to FIG. 6B, but showing an alternative jig structure.

As best seen in FIG. 6D, an additional aspect having a modified jig 142A is shown. In this aspect, the parts of jig 142A corresponding to jig 142 are similarly labeled, and are the same as those described above. Jig 142A differs from jig 142 in that bar 152A generally extends around the perimeter of airbag 130 (rather than extending longitudinally in-line with the center axis of airbag 130). Additionally, arms 158A are configured differently, as shown in FIG. 6D, but operate as arms 158 to support masking elements 156. The jig 142 is preferred, as it has been found to offer better, more even coverage of the coating than experienced using jig 142A.

Figure 7A:
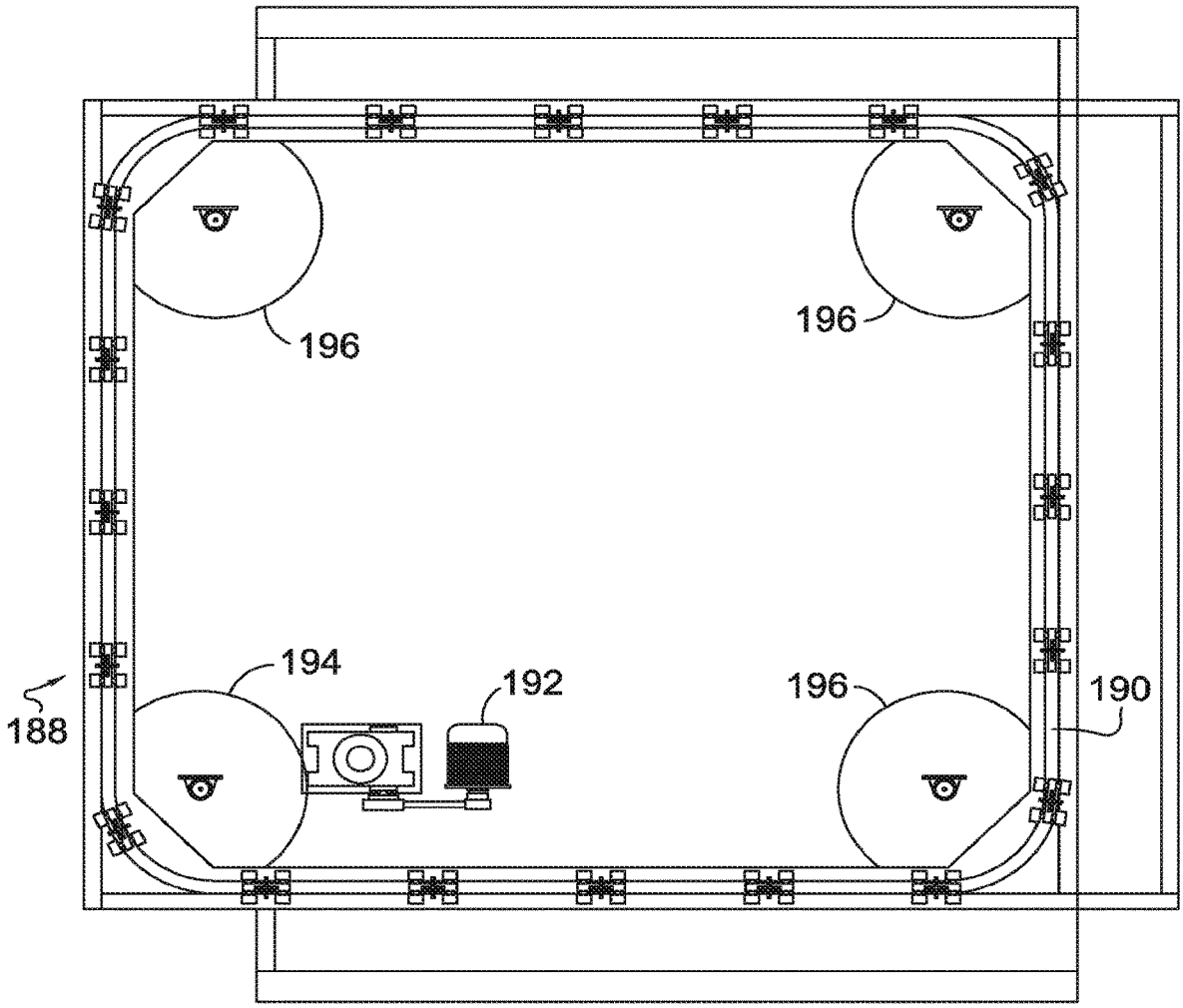
FIG. 7A depicts a top view of the transport system of the system of FIG. 1, in accordance with aspects hereof.
Figure 7B:
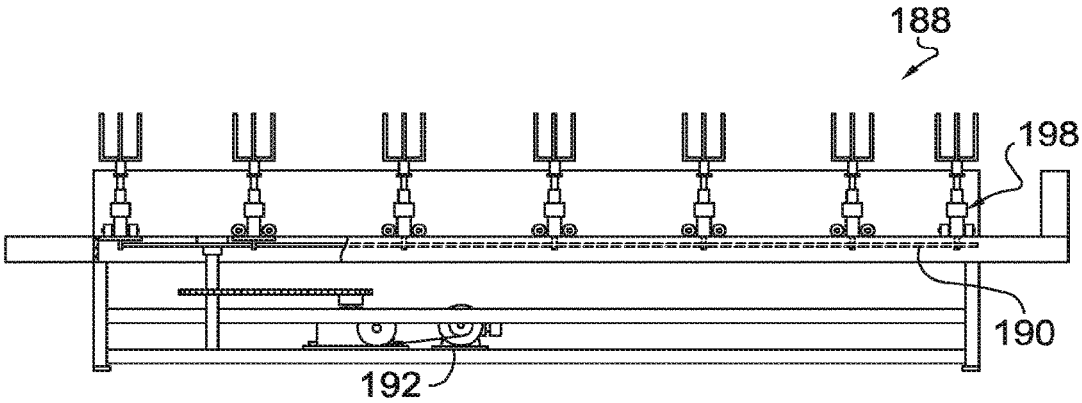
FIG. 7B depicts a side view of the transport system and spindles, with parts removed for clarity, in accordance with aspects hereof.
Figure 8:
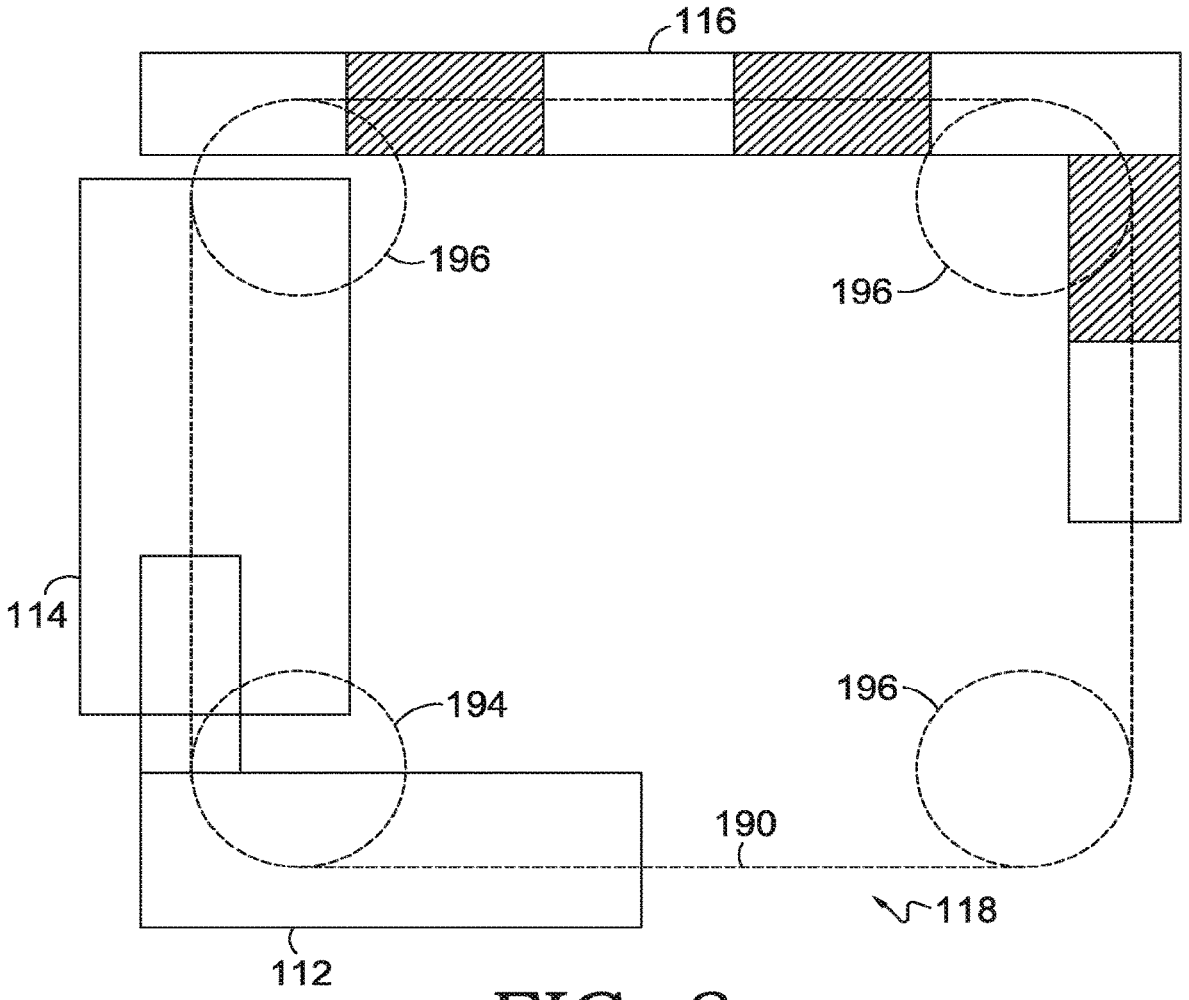
FIG. 8 is a simplified view of the transport system and system components of the system of FIG. 1.
Figure 10:
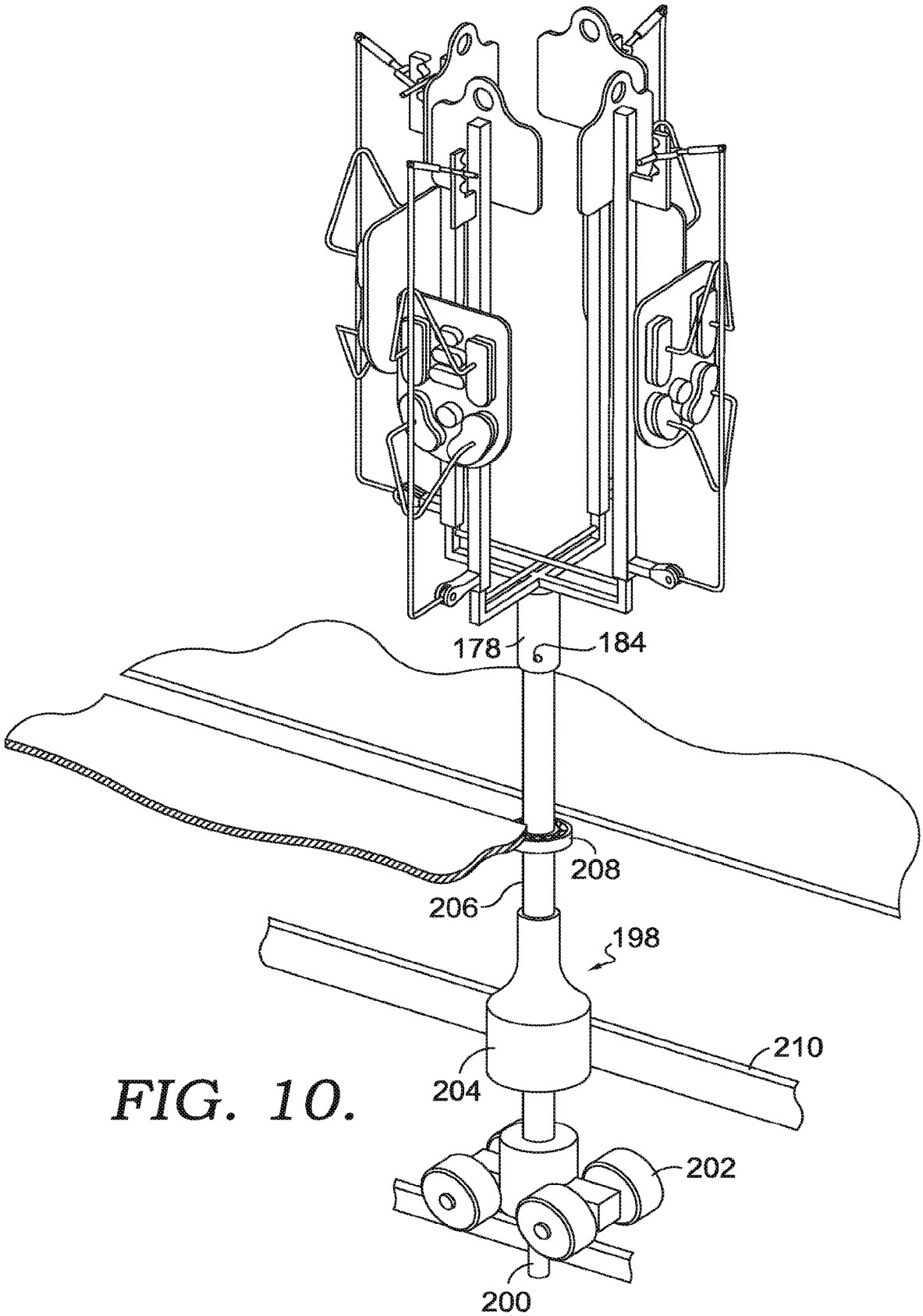
FIG. 10 depicts a portion of the interior of the coating chamber with parts broken away to show details, in accordance with aspects hereof.

The airbags 130 next enter a series of stations best seen in FIG. 6. As shown in FIG. 6, a transport system 188 routes the airbags 130 through preheating chamber 112, coating chamber 114 and second drying chamber 116. In some aspects, as best seen in FIGS. 7A and 7B, transport system 188 includes a chain 190 that is driven in a rectangular path with a motor 192 that turns a drive gear 194, guided by additional gears 196 in each of the other corners. The chain 190 carries a number of spaced spindles 198 as best seen in FIG. 7B and FIG. 10. Each spindle 198 has a chain connection pin 200 at its base. The chain connection pin 200 connects spindle 198 to the chain 190, such that the spindle 198 moves as the chain 190 moves. In some aspects, each spindle also has a pair of roller assemblies 202 that are coupled to the spindle. Each roller assembly 202, in some aspects, has two rollers that help support and guide the spindle 198 as it follows the path of chain 190. Above the roller assemblies 202, each spindle has a spindle roller 204 that is coupled to a shaft 206. The spindle roller 204 operates to rotate the spindle shaft 206, when the spindle roller 204 comes in contact with a rotational force, as described below. Above the spindle roller 204, the spindle 198 has a bearing 208 coupled on spindle shaft 206 that operates to position and guide the spindle 198, through spindle shaft 206.

In some aspects, an individual carrier 176, loaded with jig 142 and airbag 130 is coupled to a corresponding spindle 198 at carrier loading station 110. This coupling is achieved by placing base 178 onto the top of spindle shaft 206, and tightening set screw 184. In other words, shaft 206 rests within hole 180 on base 178, and set screw 184 is used to attach carrier 176 to spindle 198. In other aspects, carrier 176 is coupled to spindle 198 (with shaft 206 resting within hole 180 on base 178 of carrier 176, and tightening set screw 184) before jigs 142 are coupled to carrier 176. In this aspect, carriers 176 remain in place on spindles 198. At carrier loading station 110, in this aspect, jigs 142 are loaded onto the prongs 182 of each carrier 176 at the carrier loading station 110. In other words, carriers 176 remain in place on spindles 198, and as empty carriers 176 are moved into place (by spindles 198 and chain 190) an operator merely loads jigs 142 (already loaded with an airbag 130) onto the four prongs 182 of each carrier 176.

Chain 190 routes the loaded carriers 176 into the preheating chamber 112. Preheating chamber 112, like first drying chamber 108, may be equipped with heaters (such as a pin heater) and blowers (such as a fan) to raise the temperature of the airbags 130 to allow the coating material to better adhere to the airbags 130. Following preheating chamber 112, the chain 190 moves the spindle 198 (loaded with airbags 130 on carrier 176) into the coating chamber 114.

Figure 9:
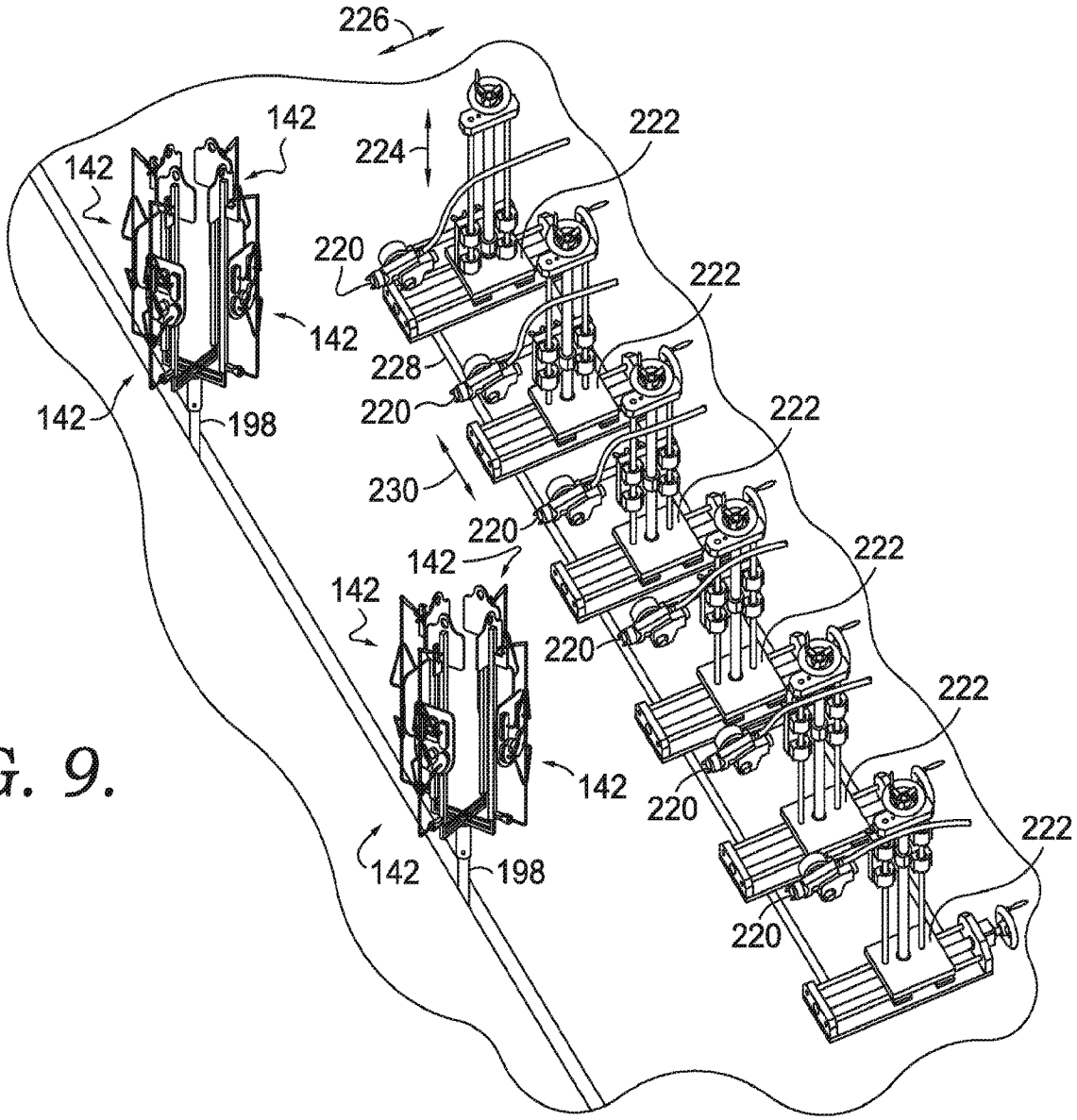
FIG. 9 depicts a perspective view of a portion of the interior of the coating chamber of the system of FIG. 1, in accordance with aspects hereof.

As the loaded spindles 198 are moved into coating chamber 114, the spindle roller 204 is moved into contact with a rotating belt 210 (as best seen in FIG. 10). Belt 210 spins spindle 198, and therefore, jigs 142 and airbags 130, rotating the assembly about an axis of rotation at the center of shaft 206. The now rotating airbags 130 are moved through coating chamber 114 and are moved past a number of spray guns 220 as seen in FIG. 9. In one aspect, spray gun 220 is a low pressure spray gun that delivers a coating material (such as paint) to the airbags 130. The coating material is delivered to each spray gun 220 though tubes that are connected to a coating material storage, such as a paint tank. In some aspects, each spray gun 220 is mounted on an X-Y slider 222, as best seen in FIG. 9. Each X-Y slider 222 allows the spray gun 220 to be positioned vertically relative to the airbags 130 (as depicted by arrow 224), as well as allowing each spray gun 220 to be positioned closer to, or further from, the airbags 130 (as depicted by arrow 226). Further, in some aspects, each X-Y slider 222 is carried on shafts 228 that allow X-Y sliders 222 (and thus spray guns 220) to be positioned back-and-forth along coating chamber 114 (as depicted by arrow 230). As shown in FIG. 9, in some aspects, coating chamber 114 has six spray guns 220, mounted on six X-Y sliders 222. Depending on the component being coated (such as airbag 130), more, or fewer, spray guns 220 could be installed with coating chamber 114. As best seen in FIG. 9, the spray guns 220 may be vertically positioned, with respect to airbags 130 on carriers 176, to achieve complete coating coverage of the airbags 130. In some aspects, the spray guns are positioned from lower to higher along coating chamber 114, or higher to lower along coating chamber 114, although other positioning could also be used. As the airbags 130 are moved through coating chamber 114, carried by jig 142 on chain 190, belt 210 rotates or spins the airbags 130. As the airbags 130 rotate, the coating material is applied to the airbags, with the exception of those areas masked by masking elements 156. Because the jigs 142 and airbags 130 are rotating, the bar 152 on jig 142 does not interfere with coating coverage.

Chain 190 moves the carrier 176 (with jigs 142 and airbags 130) out of the coating chamber 114 and into second drying chamber 116. Like first drying chamber 108, second drying chamber 116 may be equipped with both heating components and air moving components. In one aspect, second drying chamber has pin heaters for the heating components and blowers or fans for the air moving components. Chain 190 routes the carrier 176, jigs 142 and airbags 130 through second drying chamber 116 and to carrier unloading station 118.

At carrier unloading station 118, in one aspect, jigs 142 are removed from carrier 176 by moving the jig 142 upwardly, releasing prong 182 from inside support tube 145. The individual airbag 130/jig 142 combination is then placed on a conveyor 240 that moves the airbag 130/jig 142 combination through the third drying chamber 120. In other aspects, the entire carrier 176 can be removed from the spindle 198 and can be routed through third drying chamber 120. Like first drying chamber 108 and second drying chamber 116, third drying chamber 120 may also be equipped with both heating components and air moving components. In one aspect, third drying chamber has pin heaters for the heating components and blowers or fans for the air moving components. As the jigs 142 exit the third drying chamber they arrive at jig unloading station 122, where an operator unloads airbag 130 from jig 142. To unload airbag 130 from jig 142, the operator releases closing pin 164 from the notch 168 in rack 166 on jig 142 and pivots finger 160 away from rack 166 about pivot point 162. If the alternative closure mechanism of FIG. 4 is used, the operator releases bar 152 by rotating closing pin 177. The operator can then rotate bar 152 on pivot point 154 to access airbag 130 and can remove airbag 130 from platform 148. After removal, the operator places airbag 130 on a conveyor 242 taking the airbag 130 passed quality assurance and packing station 124.

In some aspects, the system 100 also includes exhaust systems. The exhaust systems extract air from within the system 100 to aid in reducing an internal temperature of the system 100 and/or to remove particulate, off gases, or other undesired elements from within the system 100 that are generated during the operation of the system 100. The exhaust may be a fan or other blower effective to extract gas from within the system 100. Any number of exhaust elements may be incorporated into the system 100 in various aspects.

In some aspects, the system 100, or certain components of system 100, may be controlled by a controller, such as a computing device effective to control one or more of the components of the system 100, such as the preheating chamber 112, coating chamber 114, and second drying chamber 116. The controller typically includes a variety of computer-readable media and a processor. Computer-readable media can be any available media that can be accessed by the controller and includes both volatile and nonvolatile media, removable and non-removable media. By way of example, and not limitation, computer-readable media may comprise computer-storage media and communication media. Computer-storage media includes both volatile and nonvolatile, removable and non-removable media implemented in any method or technology for storage of information such as computer-readable instructions, data structures, program modules or other data.

Computer-storage media includes RAM, ROM, EEPROM, flash memory or other memory technology, CD-ROM, digital versatile disks (DVD) or other optical disk storage, magnetic cassettes, magnetic tape, magnetic disk storage or other magnetic storage devices. Computer storage media does not comprise a propagated data signal.

Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer-readable media.

Memory includes computer-storage media in the form of volatile and/or nonvolatile memory. The memory of the controller may be removable, nonremovable, or a combination thereof. Exemplary memory includes non-transitory, solid-state memory, hard drives, optical-disc drives, etc. The controller includes one or more processors that read data from various entities such as bus, memory, or I/O components. Presentation component(s) may be included that present data indication to a person or other device. Exemplary presentation components include a display device, speaker, printing component, vibrating component, etc. I/O ports of the controller allow the controller to be logically coupled to other devices including I/O components, some of which may be built in. Illustrative I/O components include the input device. A logical coupling that allows for a logically coupled connection is a wired or wireless communication between two devices. Example of a logical coupling include, but are not limited to, near field electronic communication, WiFi, Bluetooth, infrared light, and the like. Examples of wired logical coupling include, but are not limited to, Ethernet, direct bus wiring, and the like. A logically coupled first device and second device are able to communicate data at least in one direction, if not between the two devices.

The controller is logically coupled by a logical coupling to one or more features of the system 100. For example, the controller may be logically coupled in a wired and/or wireless manner to the preheating chamber 112, the drying chambers 108, 116, and/or 120, the coating chamber 114 (including spray guns 220 and belt 210), motor 192, or other elements of system 100. The logical coupling is a wired and/or wireless connection that facilitates the transfer of data, as is known in the art.

An input device is optionally provided. The input device may be any input device effective to provide information to the controller or the system 100 in general through a logical coupling that is a wired or wireless connection that facilitates the transfer of data between the input device and one or more components. Examples of exemplary input devices include, but are not limited to, bar code scanners, vision systems, keyboards, cursor manipulators (e.g., computer mouse), radio-frequency identification readers, and the like. For example, it is contemplated that a specific conditions (e.g., process recipe) may be recalled or developed for a specific cushioning pod configuration. The protocol may be retrieved from computer storage through an input from the input device. For example, an identifier, such as a bar code or other identification, may be present on the cushioning pod, the film jig, a work order, or other element. The input device is used to input the identification, which causes a unique protocol to be load and performed by the system 100 on the cushioning pod structure. Use of unique protocols allows for on-the-fly custom forming of various cushioning pod structures with a common system.

While specific components and features are discussed in connection with the system 100, it is understood that one or more may be omitted in some aspects. Further, while specific components and features are discussed in connection with the system 100, it is contemplated that additional components and features may be included while staying within the scope of aspects contemplated. Further, while a specific number, configuration, size, position, and orientation of components comprising the system 100 are depicted and/or described, it is understood this is for illustration purposes only is not limiting unless explicitly indicated to the contrary. Therefore, in some aspects it is contemplated that alternative numbers, configurations, sizes, positions, and/or orientations may be implemented in connection with one or more components of the system 100.

The configuration of masking elements 156 is exemplary in nature. It is contemplated that any configuration suitable for masking desired areas or portions of airbag 130 may be implemented in aspects contemplated. Further, while a specific configuration is depicted for airbag 130, it is understood that the illustration is not limiting, but instead an example. Alternative sizes, configuration, and structures may be used in any combination to form the airbag 130.

Figure 11:
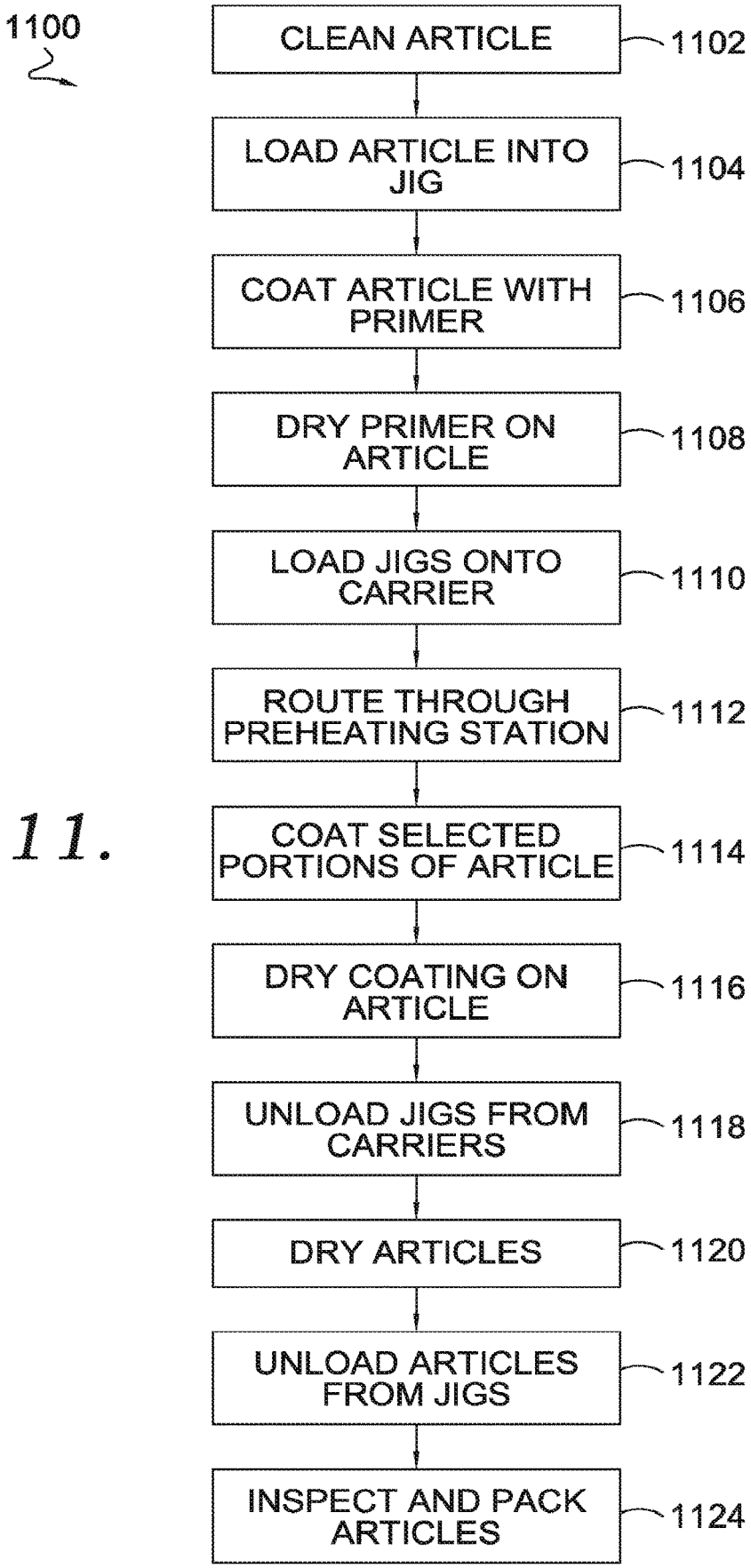
FIG. 11 depicts a flow diagram illustrating a method for selectively coating portions of an article, in accordance with aspects hereof.

FIG. 11 depicts a flow diagram illustrating a method for selectively applying a coating to portions of an article, such as airbag 130, in accordance with aspects hereof. At a block 1102 an article, such as airbag 130 is cleaned at a cleaning station, such as the airbag 130 at cleaning station 102. At a block 1104, the article is loaded into a jig, such as loading airbag 130 into jig 142. As described above, the jig is equipped with masking elements that selectively block certain portions of the article from being coated with a coating material. At a block 1106, the article is coated with a primer material, such as by an operator placing the jig 142 on the stand 174, and applying a primer to the airbag 130. At a block 1108, the jig and article are routed through a first drying station, such as drying chamber 108. At a block 1110, the jigs are loaded onto a carrier, such as loading jigs 142 onto carrier 176. In some aspects, at a block 1112, the carrier 176 is routed through a preheating station, such as preheating chamber 112. At a block 1114, the carrier is routed through a coating chamber, such as coating chamber 114. This coating operation may include a spinning the carrier and jig assembly as it is driven past a series of spray guns, such as by using belt 210 to rotate spindle 198 and carrier 176 as the spindle assembly is routed past spray guns 220. At a block 1116, the carrier is routed through a drying chamber, such as second drying chamber 116. At a block 1118, the jigs are unloaded from the carriers, such as unloading jigs 142 from carriers 176 at carrier unloading station 118. At a block 1120, the jigs are routed through a drying chamber, such as moving jigs 142 through third drying chamber 120. At a block 1122, the articles are unloaded from the jigs, such as unloading airbags 130 from jigs 142 at jig unloading station 122. At a block 1124, the articles are routed through a quality assurance station and to a packing station, such as by routing airbags 130 past quality assurance and packing station 124.

Additional steps are provided in the disclosure that may incorporated into the method depicted in FIG. 11. Further, it is contemplated that one or more of the steps (aka blocks) of FIG. 11 may be omitted. Further yet, one or more steps indicated as occurring concurrently or subsequently may be adjusted to achieve aspects provided herein.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations. This is contemplated by and is within the scope of the claims.

While specific elements and steps are discussed in connection to one another, it is understood that any element and/or steps provided herein is contemplated as being combinable with any other elements and/or steps regardless of explicit provision of the same while still being within the scope provided herein. Since many possible embodiments may be made of the disclosure without departing from the scope thereof, it is to be understood that all matter herein set forth or shown in the accompanying drawings is to be interpreted as illustrative and not in a limiting sense.

From the foregoing, it will be seen that this invention is one well-adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

As used herein and in connection with the claims listed hereinafter, the terminology "any of clauses" or similar variations of said terminology is intended to be interpreted such that features of claims/clauses may be combined in any combination. For example, an exemplary clause 4 may indicate the method/apparatus of any of clauses 1 through 3, which is intended to be interpreted such that features of clause 1 and clause 4 may be combined, elements of clause 2 and clause 4 may be combined, elements of clause 3 and 4 may be combined, elements of clauses 1, 2, and 4 may be combined, elements of clauses 2, 3, and 4 may be combined, elements of clauses 1, 2, 3, and 4 may be combined, and/or other variations. Further, the terminology "any of clauses" or similar variations of said terminology is intended to include "any one of clauses" or other variations of such terminology, as indicated by some of the examples provided above.

The following clauses are aspects contemplated herein.

Clause 1. A system for selectively applying a coating to portions of an article having at least one area that is not be coated, the system comprising: at least one jig, comprising: a platform for supporting at least one surface of the article; a bar movable with respect to the platform; at least one masking element coupled to the bar and configured to cover the at least one area of the article that is not to be coated; and a first connection mechanism defining a first mating element; and at least one carrier comprising; a base; and at least one second connection mechanism defining a second mating element, the second mating element mateable with the first mating element such that the jig is releasably coupled to the carrier upon mating the first mating element with the second mating element.

Clause 2. The system of clause 1, wherein the first mating element is non-rotatable with respect to the second mating element upon mating the first mating element with the second mating element.

Clause 3. The system of clause 2, wherein the first mating element is a hollow square tube and the second mating element is a square prong extending upwardly from the base of the carrier.

Clause 4. The system of clause 3, wherein the square prong has a tapered terminal end distal from the base.

Clause 5. The system of clause 4, wherein the base of the carrier supports four second mating elements, each mateable with a first mating element of a corresponding jig.

Clause 6. The system of any of clauses 1-5, wherein the bar is moveable between an open position allowing the article to be placed on the platform and a closed position where the bar maintains the article in place on the platform, and wherein the jig further comprises a closure mechanism releasably securing the bar in the closed position.

Clause 7. The system of clause 6, wherein the closure mechanism has multiple closure settings varying a distance between the at least one masking element and the platform.

Clause 8. The system of clause 7, wherein the closure mechanism has at least three closure settings.

Clause 9. The system of any of clauses 1-8, wherein the platform has a longitudinal axis, and where the bar is aligned with the longitudinal axis of the platform.

Clause 10. The system of any of clauses 1-9, wherein the at least one area not to be covered is a protrusion, having a top and at least one side, and wherein the at least one masking element has a top and at least one side wall that cover at least a portion of the top and at least one side of the protrusion when the bar is in the closed position.

Clause 11. The system of clause 10, further comprising: a transport system; at least one spindle having first and second ends, the first end coupled to the transport system and the second end coupled to the base of the carrier; and a coating chamber, wherein the transport system moves the spindle through the coating chamber.

Clause 12. The system of clause 11, wherein the transport system is a chain driven by a motor.

Clause 13. The system of clause 12, wherein the coating chamber comprises: at least one belt; and at least one spray gun adapted to supply a coating material to the article, wherein at least a portion of the spindle is brought into engagement with the belt as the transport system moves the spindle through the coating chamber, rotating the spindle with respect to the spray gun.

Clause 14. The system of clause 13, wherein the at least one spray gun is coupled to an x-y table and the position of the at least one spray gun is adjustable by the x-y table.

Clause 15. A system for selectively applying a coating to portions of an article having at least one area that is not be coated, the system comprising: at least one jig, comprising: a platform for supporting at least one surface of the article; a bar movable with respect to the platform; at least one masking element coupled to the bar and configured to cover the at least one area of the article that is not to be coated; and a first connection mechanism defining a first mating element; at least one carrier comprising; a base; and at least one second connection mechanism defining a second mating element, the second mating element mateable with the first mating element such that the jig is releasably coupled to the carrier upon mating the first mating element with the second mating element; a transport system; at least one spindle having first and second ends, the first end coupled to the transport system and the second end coupled to the base of the carrier; and a coating chamber, wherein the transport system moves the spindle through the coating chamber.

Clause 16. The system of clause 15, wherein the transport system is a chain driven by a motor.

Clause 17. The system of clause 16, wherein the coating chamber comprises: at least one belt; and at least one spray gun adapted to supply a coating material to the article, wherein at least a portion of the spindle is brought into engagement with the belt as the transport system moves the spindle through the coating chamber, rotating the spindle, carrier, jig and article with respect to the spray gun.

Clause 18. The system of any of clauses 15-17, wherein the first mating element is non-rotatable with respect to the second mating element upon mating the first mating element with the second mating element.

Clause 19. The system of clause 18, wherein the first mating element is a hollow square tube and the second mating element is a square prong extending upwardly from the base of the carrier.

Clause 20. The system of clause 19, wherein the square prong has a tapered terminal end distal from the base.

Clause 21. The system of clause 20, wherein the base of the carrier supports four second mating elements, each mateable with a first mating element of a corresponding jig.

Clause 22. The system of any of clauses 15-21, wherein the bar is moveable between an open position allowing the article to be placed on the platform and a closed position where the bar maintains the article in place on the platform, and wherein the jig further comprises a closure mechanism releasably securing the bar in the closed position.

Clause 23. The system of clause 22, wherein the closure mechanism has multiple closure settings varying a distance between the at least one masking element and the platform.

Clause 24. The system of clause 23, wherein the closure mechanism has at least three closure settings.

Clause 25. The system of any of clauses 15-24, wherein the platform has a longitudinal axis, and where the bar is aligned with the longitudinal axis of the platform.

Clause 26. The system of any of clauses 15-25, wherein the at least one area not to be covered is a protrusion, having a top and at least one side, and wherein the at least one masking element has a top and at least one side wall that cover at least a portion of the top and at least one side of the protrusion when the bar is in the closed position.

Clause 27. A method for applying a coating to portions of an article having at least one area that is not to be coated, the method comprising: securing at least one article on a jig; coupling the jig to a carrier moveable by a transport system;

transporting the at least one article, jig and carrier to a coating station; within the coating station, rotating the jig about a vertical axis to rotate the at least one article; and transporting the rotating jig past a spray gun that applies a coating material to the at least one article in the jig.

Clause 28. The method of clause 27, further wherein at least four jigs are each loaded with at least one article, and wherein the at least four jigs are all coupled to the same carrier.

Clause 29. The method of clause 28, further comprising transporting the carrier through a preheating station before the coating station.

Clause 30. The method of clause 29, further comprising transporting the carrier through at least one drying station after the coating station, wherein the jig is not subjected to a rotational force in the at least one drying station.

Clause 31. A system for selectively applying a coating to portions of an article having at least one area that is not be coated, the system comprising: at least one jig, comprising: a platform for supporting at least one surface of the article; a bar movable with respect to the platform; and at least one masking element coupled to the bar and configured to cover the at least one area of the article that is not to be coated; at least one carrier connected to the at least one jig, the carrier having a base; a transport system; at least one spindle having first and second ends, the first end coupled to the transport system and the second end coupled to the base of the carrier; and a coating chamber, wherein the transport system moves the spindle through the coating chamber.

Clause 32. The system of clause 31, wherein the at least one jig further comprises a first connection mechanism defining a first mating element; and wherein the carrier further comprises at least one second connection mechanism defining a second mating element, the second mating element mateable with the first mating element to connect the jig to the carrier.

Clause 33. The system of clause 32, wherein the second connection mechanism releasably couples the jig to the carrier, such that the jig is selectively removeable from the carrier.

Clause 34. The system of any of clauses 31-33, wherein the transport system is a chain driven by a motor.

Clause 35. The system of clause 34, wherein the coating chamber comprises: at least one belt; and at least one spray gun adapted to supply a coating material to the article, wherein at least a portion of the spindle is brought into engagement with the belt as the transport system moves the spindle through the coating chamber, rotating the spindle, carrier, jig and article with respect to the spray gun.

Clause 36. The system of clause 33, wherein the first mating element is non-rotatable with respect to the second mating element upon mating the first mating element with the second mating element.

Clause 37. The system of clause 36, wherein the first mating element is a hollow square tube and the second mating element is a square prong extending upwardly from the base of the carrier.

Clause 38. The system of clause 33, wherein the base of the carrier supports four second mating elements, each coupled to a first mating element of a corresponding jig.

Clause 39. The system of any of clauses 31-38, wherein the bar is moveable between an open position allowing the article to be placed on the platform and a closed position where the bar maintains the article in place on the platform, and wherein the jig further comprises a closure mechanism releasably securing the bar in the closed position.

Clause 40. The system of clause 39, wherein the closure mechanism has multiple closure settings varying a distance between the at least one masking element and the platform.

The invention claimed is:

1. A system for selectively applying a coating to portions of an article having at least one area that is not be coated, the system comprising:

at least one jig, comprising:

a support tube having a first shape;

a platform for supporting at least one surface of the article, the platform coupled to the support tube and extending outwardly therefrom;

a bar pivotally coupled to the support tube and pivotally movable with respect to the platform;

at least one mask coupled to the bar and extending from the bar towards the platform, the mask having a shape and form that covers the at least one area of the article that is not to be coated when the mask is engaged with the article; and at least one carrier comprising:

a base; and at least one prong having a second shape, the second shape of the prong mateable with the first shape of the support tube such that the jig is releasably coupled to the carrier upon mating the support tube with the prong.

2. The system of claim 1, wherein the support tube is non-rotatable with respect to the prong upon mating the support tube with the prong.

3. The system of claim 2, wherein the support tube is a hollow square tube and the prong is a square prong extending upwardly from the base of the carrier.

4. The system of claim 3, wherein the square prong has a tapered terminal end distal from the base.

5. The system of claim 4, wherein the base of the carrier supports four of the prongs, each prong mateable with a support tube of a corresponding jig.

6. The system of claim 1, wherein the bar is moveable between an open position allowing the article to be placed on the platform and a closed position where the bar maintains the article in place on the platform, and wherein the jig further comprises a closure mechanism releasably securing the bar in the closed position.

7. The system of claim 6, wherein the closure mechanism has multiple closure settings varying a distance between the at least one mask and the platform.

8. The system of claim 7, wherein the closure mechanism has at least three closure settings.

9. The system of claim 1, wherein the platform has a longitudinal axis, and where the bar is aligned with the longitudinal axis of the platform.

10. The system of claim 1, wherein the at least one area not to be coated is a protrusion, having a top and at least one side, and wherein the at least one mask has a top and at least one side wall that cover at least a portion of the top and at least one side of the protrusion when the bar is in the closed position.

11. The system of claim 10, further comprising:

a transport system;

at least one spindle having first and second ends, the first end coupled to the transport system and the second end coupled to the base of the carrier; and a coating chamber, wherein the transport system moves the spindle through the coating chamber.

12. The system of claim 11, wherein the transport system is a chain driven by a motor.

13. The system of claim 12, wherein the coating chamber comprises:

at least one belt; and at least one spray gun adapted to supply a coating material to the article, wherein at least a portion of the spindle is brought into engagement with the belt as the transport system moves the spindle through the coating chamber, rotating the spindle with respect to the spray gun.

14. The system of claim 13, wherein the at least one spray gun is coupled to an x-y table and the position of the at least one spray gun is adjustable by the x-y table.

* * * * *